US007647901B2

(12) United States Patent
Funahashi

(10) Patent No.: US 7,647,901 B2
(45) Date of Patent: Jan. 19, 2010

(54) ENGINE WATER JACKET FOR WATER PLANING BOAT

(75) Inventor: Keiya Funahashi, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 62 days.

(21) Appl. No.: 11/507,703

(22) Filed: Aug. 22, 2006

(65) Prior Publication Data

US 2007/0089693 A1 Apr. 26, 2007

(30) Foreign Application Priority Data

Aug. 22, 2005 (JP) ..... 2005-239964

(51) Int. Cl.
*F02F 1/40* (2006.01)
*F02B 75/18* (2006.01)

(52) U.S. Cl. ..... 123/41.82 R; 123/41.74

(58) Field of Classification Search ..... 123/41.82 R, 123/41.72, 41.74, 195 AC; 440/88 C, 88 D, 440/88 J, 88 R
See application file for complete search history.

(56) References Cited

U.S. PATENT DOCUMENTS

| | | | | |
|---|---|---|---|---|
| 1,457,943 | A * | 6/1923 | Short | 123/41.82 R |
| 2,010,782 | A * | 8/1935 | Fahlman | 123/41.82 R |
| 3,137,281 | A * | 6/1964 | Fulker | 440/88 C |
| 4,284,037 | A * | 8/1981 | Kasting et al. | 123/41.72 |
| 6,408,802 | B1 | 6/2002 | Funahashi | |
| 7,455,035 | B2 | 11/2008 | Sanai | |
| 2004/0200444 | A1 * | 10/2004 | Sugano et al. | 123/41.82 R |
| 2006/0065230 | A1 * | 3/2006 | Hoi | 123/196 AB |

FOREIGN PATENT DOCUMENTS

| | | |
|---|---|---|
| JP | A-2002-161803 | 6/2002 |
| JP | 2002-242673 | 8/2002 |

* cited by examiner

*Primary Examiner*—Noah Kamen
(74) *Attorney, Agent, or Firm*—Keating & Bennett, LLP

(57) ABSTRACT

An engine for a planing-type boat can have a water jacket, which is provided in a main body of the engine and which is supplied with cooling water for cooling the engine. The water jacket can include a ceiling with its rearward portion higher than its forward portion. The water jacket can also include a water drain provided at the rear highest portion of the ceiling to discharge cooling water out of the water jacket. In addition, a head bolt fastening portion for receiving a bolt is provided on an outer side portion of the water jacket in the cylinder head, and a rib is provided in a portion of the water jacket that corresponds to the head bolt fastening portion.

14 Claims, 8 Drawing Sheets

ENGINE WATER JACKET FOR WATER PLANING BOAT

PRIORITY INFORMATION

This application is based on and claims priority under 35 U.S.C. §119 to Japanese Patent Application No. 2005-239964, filed on Aug. 22, 2005, the entire contents of which is hereby expressly incorporated by reference herein.

BACKGROUND OF THE INVENTIONS

1. Field of the Inventions

The present inventions relate to cooling systems for engines, and more particularly, an engine water jacket that can be provided on the upper side of an engine body.

2. Description of the Related Art

Certain typical water-cooled marine engines include a water jacket that is configured to cool the engine, including the cylinder block and cylinder head. The cooling systems of some of these marine engines are known as "open-loop" cooling systems, which use water from the body of water in which the associated boat is operating for cooling the engine.

For example, Japanese Patent Document JP-A-2002-161803 discloses such a water-cooled engine. In this design, the cooling jacket in the cylinder head has a generally horizontal ceiling.

SUMMARY OF THE INVENTION

An aspect of at least one of the inventions disclosed herein includes the realization that engines that have a water jacket with a generally horizontal ceiling in the cylinder head suffer from some disadvantages. For example, such small watercraft can be quite sporting in nature and can accelerate and turn quickly. During such sporting operations, the attitude and pitch of the hull of the watercraft can vary significantly. Such variations in the orientation of the watercraft hull can cause air to be mixed with cooling water and to enter the water jacket along with the water. Occasionally, the air can separate out of the water and accumulate in the vicinity of the ceiling of the water jacket. This can undesirably reduce the cooling effect of the water jacket.

Thus, in accordance with an embodiment, an engine water jacket can be provided for a planing-type boat. The engine water jacket can be provided on an upper side of an engine body to cool the engine with water. The engine water jacket can comprise a ceiling extending obliquely relative to a plane extending in the longitudinal direction of a boat body of the water planing boat, and a water drain provided adjacent to the highest portion of the water jacket to discharge the cooling water out of the water jacket.

In accordance with another embodiment, a watercraft can comprise a hull, an engine supported by the hull, the engine including a crankshaft and a cooling jacket. A ceiling of the cooling jacket can be disposed at an upper portion of the engine, the ceiling extending at an oblique angle relative to a surface of a body of water when the watercraft is floating at rest in the body of water.

In accordance with yet another embodiment, a marine engine can comprise a crankshaft, a main power take off disposed at a first end of the crankshaft configured to drive a propulsion unit of a boat, and a cooling jacket. The cooling jacket can have a cooling water discharge and means for guiding air upwardly and longitudinally along the engine toward the first end of the crankshaft and toward the cooling water discharge.

DETAILED DESCRIPTION OF THE PREFERRED EMBODIMENT

Figure 1:
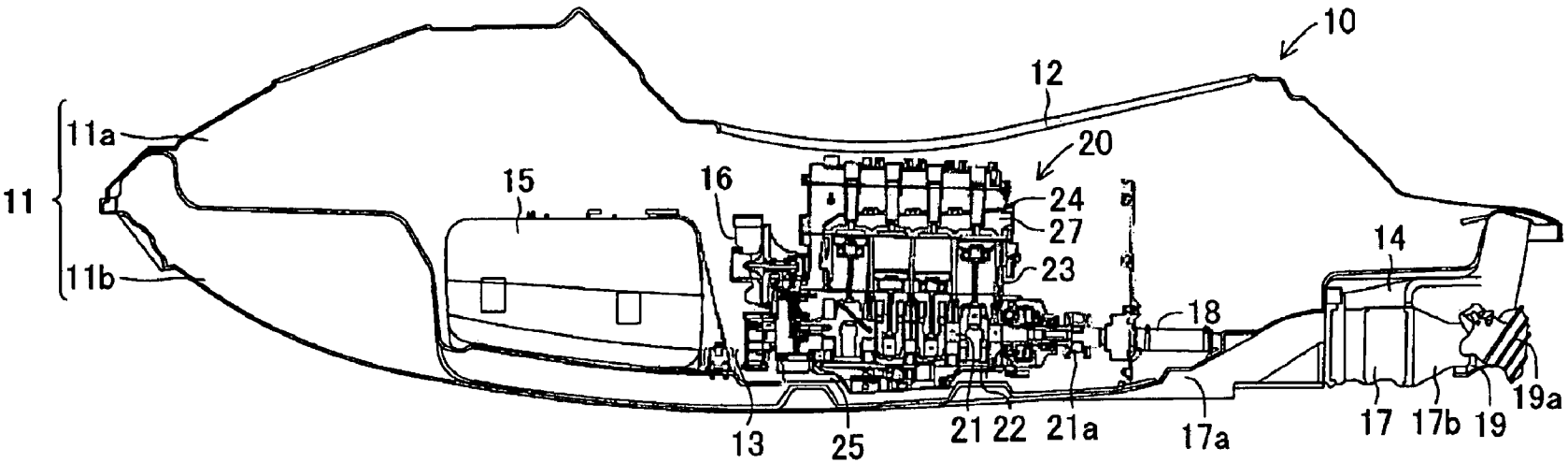
FIG. 1 is a side elevational and partial sectional view of a planing-type boat having an engine water jacket according to an embodiment.

FIG. 1 shows a planing-type boat 10 provided with a cooling system according an embodiment. The cooling system is disclosed in the context of a planing-type boat because it has particular utility in this context. However, the cooling system can be used in other contexts, such as, for example, but without limitation, outboard motors, inboard/outboard motors, and for engines of other vehicles including land vehicles.

The boat 10 can include a boat body 11 having an upper deck portion 11*a* and a lower hull portion 11*b*. The boat 10 can also include steering handlebars (not shown) disposed slightly at a forward side portion relative to the center of an upper section of the boat body 11, and a seat 12 is disposed in a center area of the upper section of the boat body 11. The handlebars and the seat can be considered as defining an "operator's area" of the boat 10.

The interior of the boat body 11 can include an engine compartment 13 that extends from the forward to central section, and a pump compartment 14 located at the rear section. However, the interior of the boat body 11 can be divided into additional separate sections with bulkheads, or it can be a single open compartment extending from the forward-most portion of the body 11 to the rearward-most portion thereof.

A fuel tank 15 and an engine 20 can be disposed in the engine compartment 13. The engine can include an intake system and an exhaust system. For example, the intake system can be any type of intake system. In some embodiments, the intake system can include a supercharger 16. The engine 20 can also include an exhaust system, as well as other systems.

In the pump compartment 14, a propulsion unit 17, including a jet pump, and the like can be disposed. In some embodiments, a bulkhead is disposed between the pump compartment 14 and the engine compartment 13. However, other configurations can also be used.

Air ducts (not shown) can be disposed on forward and rearward sides of the engine compartment 13. Such air ducts can be configured to introduce and or circulate ambient air into or through the engine compartment 13. Such air ducts can extend generally vertically from the top of the boat body 11 to the bottom of the engine compartment 13. As such,air can be drawn from the outside location of the boat 10 through the upper end of the air ducts, then through the bottom end thereof and into the engine compartment 13.

The fuel tank 15 can be located on a forward side of the engine compartment. The engine 20 can be disposed in the engine compartment 13 at the bottom center inside the boat body 11. However, other configurations can also be used.

The engine 20 can be a water-cooled, four-stroke, in-line, four-cylinder engine. However, other engines, operating on other combustion principles (e.g., 2-stoke, diesel, rotary, etc.), having other numbers of cylinders, and having other cylinder configurations.

Figure 2:
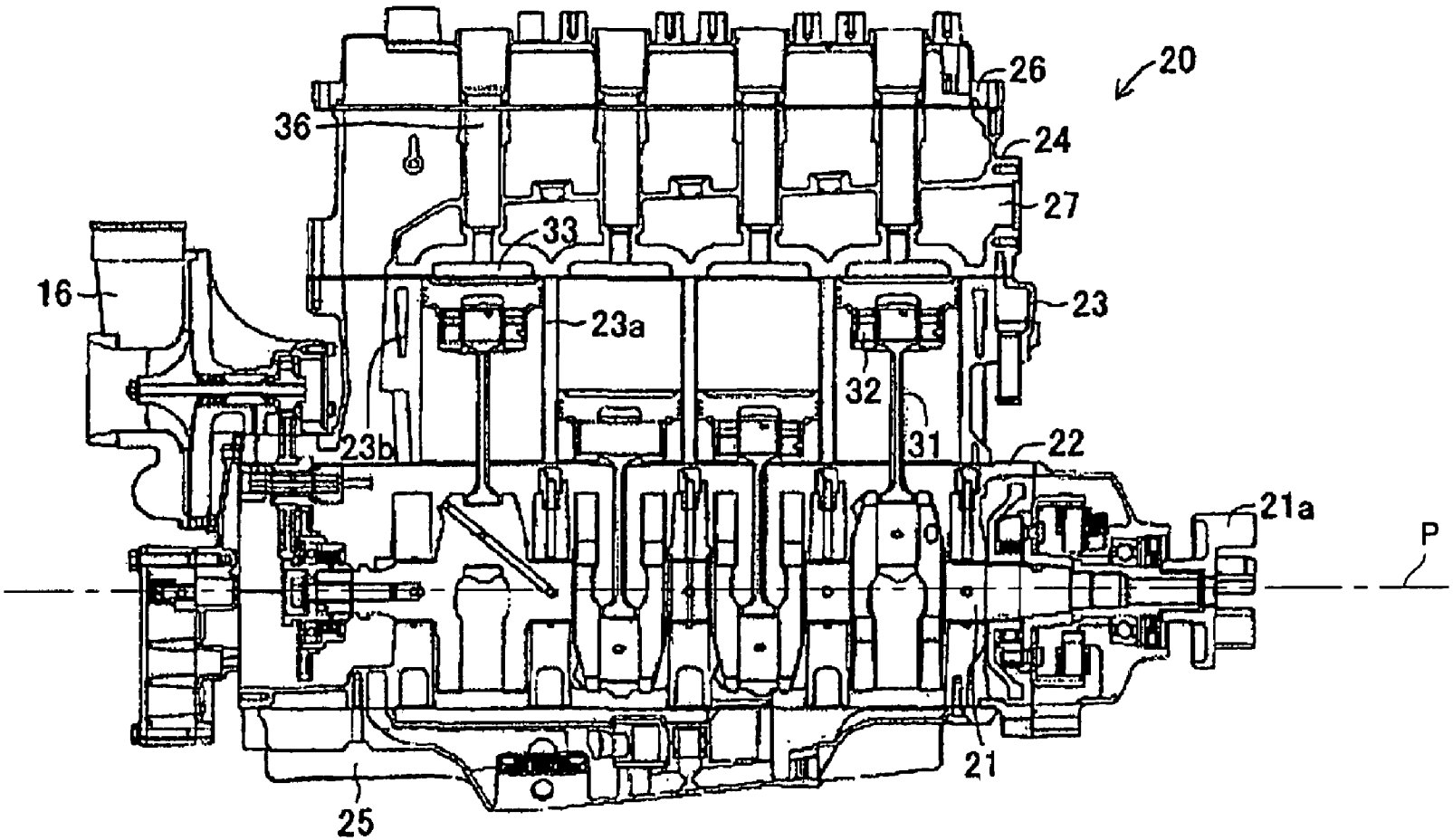
FIG. 2 is an enlarged side elevational and partial sectional view of the engine of FIG. 1.

As shown in FIG. 2, the engine 20 can have an aluminum engine body formed with a crankcase 22 in which a crankshaft 21, which extends along an axis P, is housed. However, other materials can also be used.

The engine 20 can have a cylinder body or "block" 23 and a cylinder head 24 assembled in sequence on the top of the crankcase 22. An oil pan 25 can be attached to the underside of the crankcase 22.

A head cover 26 can be attached to the topside of the cylinder head 24. Inside the cylinder head 24, a water jacket 27 can be provided.

Figure 3:
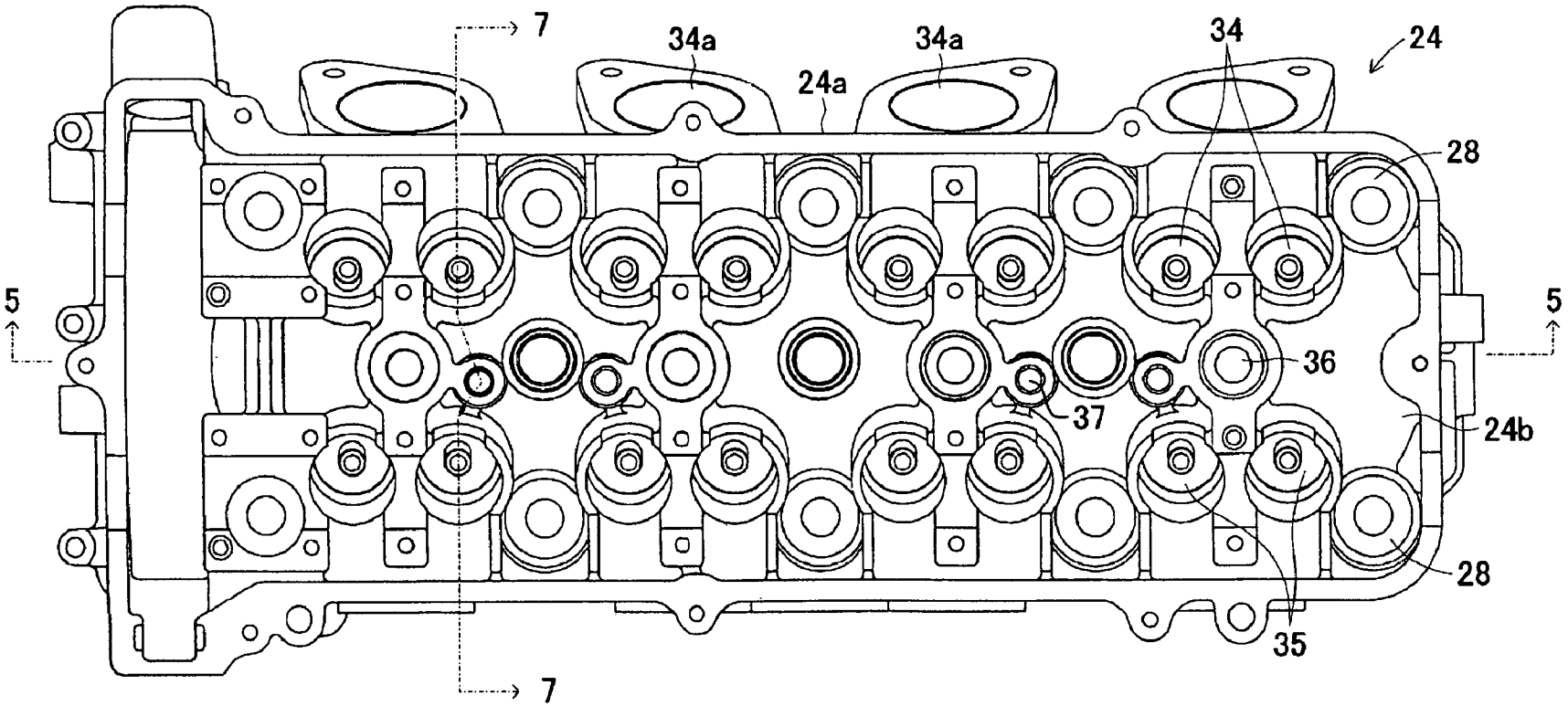
FIG. 3 is a top plan view of a cylinder head of the engine of FIG. 1.
Figure 4:
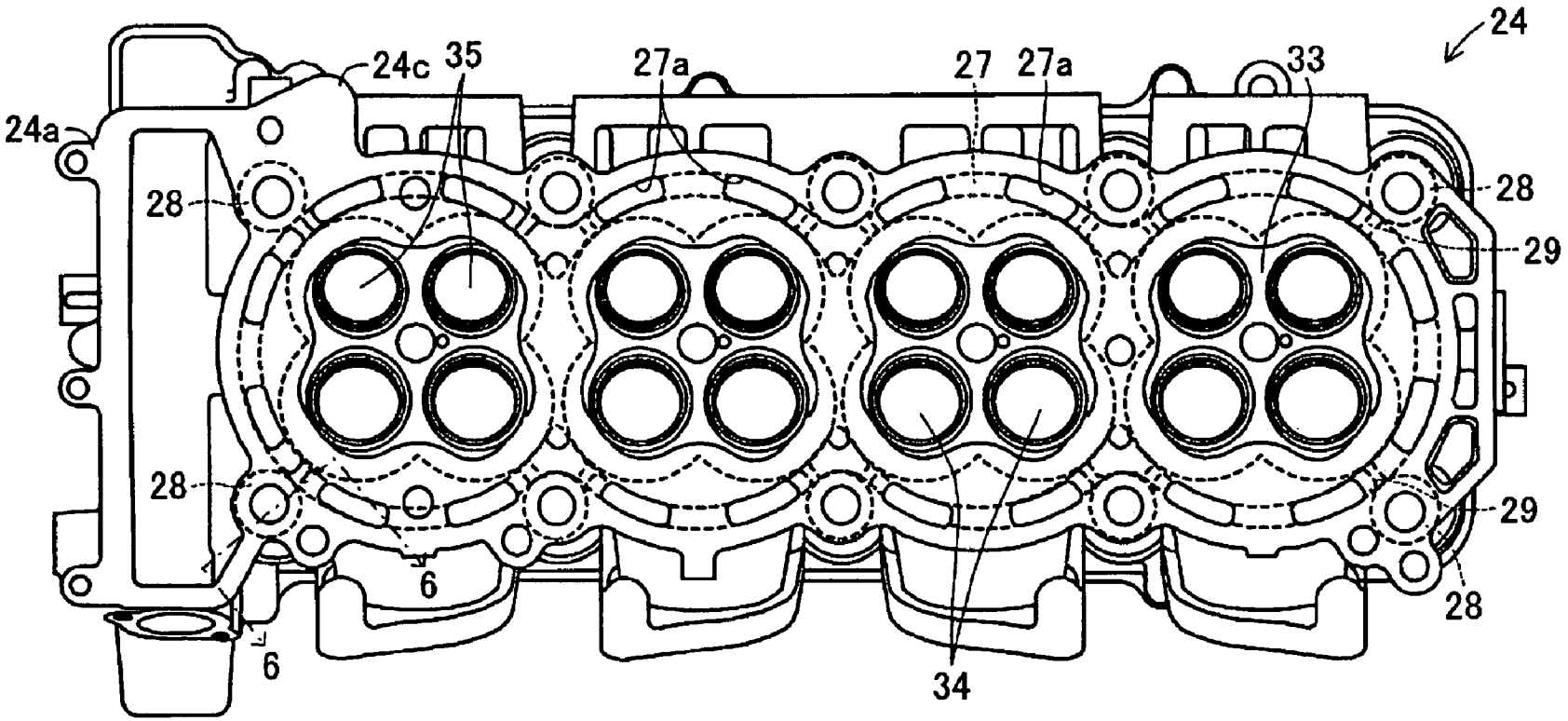
FIG. 4 is a bottom plan view of the cylinder head of FIG. 3.
Figure 5:
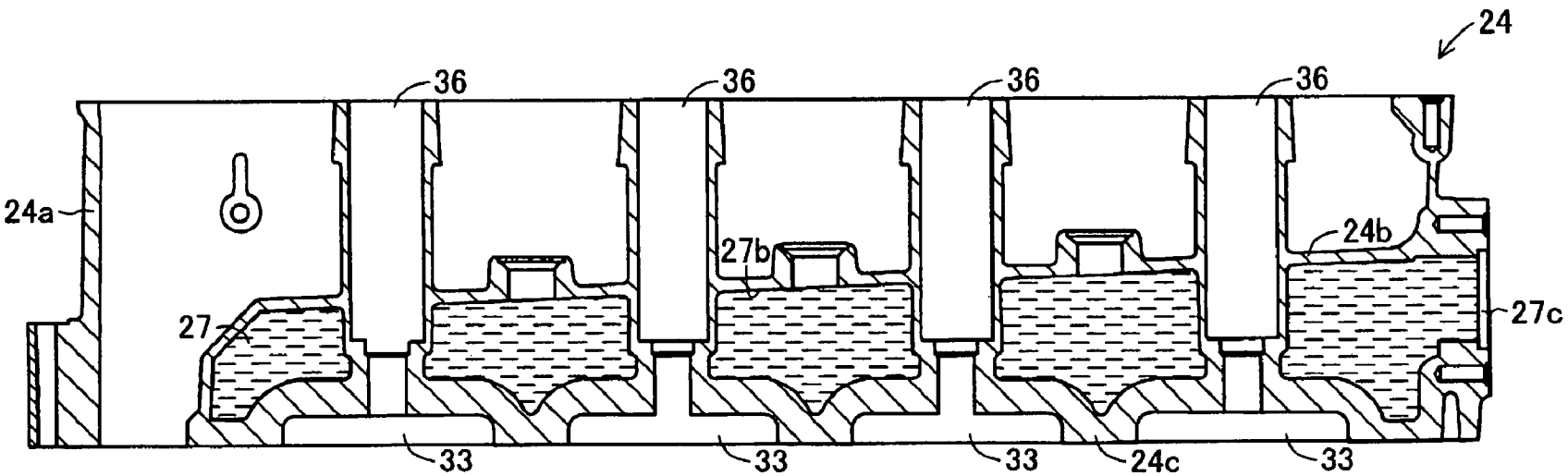
FIG. 5 is a sectional view taken along the line 5-5 of FIG. 3.

With reference to FIGS. 3-5 and initially to FIG. 3, the cylinder head 24 can include a wall section 24*a* enclosing an outer periphery of the cylinder head 24. A ceiling section 24*b* used to form a top face of the cylinder head 24. A bottom section 24*c* can be jointed to the topside of the cylinder body 23. Inside of the cylinder head 24, various devices can be disposed, such as an ignition device, and an intake and exhaust valve that both form a cylinder, discussed later in greater detail. A water jacket 27 can be provided between these devices.

The cylinder body 23 can include a cylinder barrel 23*a* forming a cylindrical column for each cylinder, and a cooling water passage 23*b* that encloses each 23*a* . The cooling water passage 23*b* can be connected to a cooling water supply pipe (not shown) to cool the cylinder body 23 using cooling water fed from the outside location of the engine 20 through the cooling water supply pipe. A top end of the cooling passage 23*b* communicates with the water jacket 27 through introduction ports 27*a* provided on the bottom section 24*c* of the cylinder head 24 with a certain gap between the adjacent introduction ports.

The introduction ports 27*a* are disposed around the outer circumference of each cylinder barrel 23*a* and can be spaced evenly therearound. However, other arrangements can also be used.

A ceiling 27*b* of the water jacket 27 (underside of the ceiling section 24*b* ) can be inclined, for example, but without limitation, with a portion lying on the forward side of the boat body 11 (a left side portion in FIGS. 3 to 5) lower than a portion lying on the rearward side thereof (a right side portion in FIGS. 3 to 5). A water drain 27*c* can also be provided at the upper rear end of the water jacket 27, and is connected to a cooling water drainpipe. The cooling water drainpipe communicates with the pump compartment 14 at the rear section of the boat body 11 to drain cooling water out of the water drain 27*c* to the outside location of the boat.

Ten (10 ) head bolt fastening portions 28 can be provided with a gap between the adjacent ones around the lower outside part of the cylinder head 24. A rib 29 can be provided on a portion on the bottom of the water jacket 27, which corresponds to each head bolt fastening portion 28.

Figure 6:
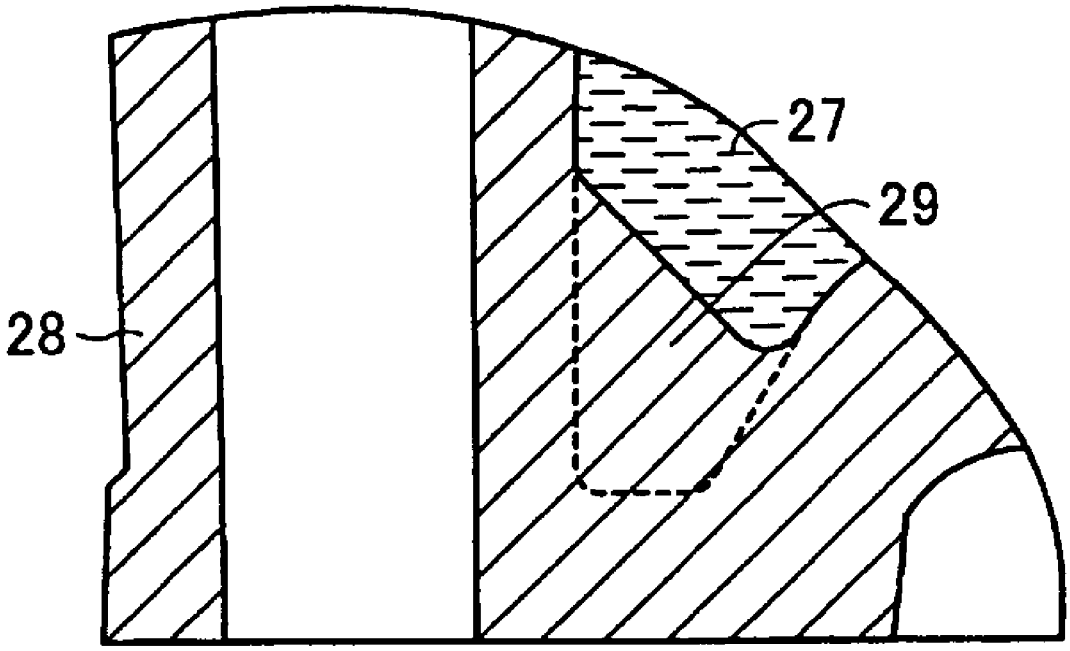
FIG. 6 is a sectional view taken along the line 6-6 of FIG. 4.

As shown in FIG. 6, the ribs 29 can extend from the head bolt fastening portion 28 toward the axis of each cylinder barrel 23*a*. Each of the four head bolt fastening portions 28, which are respectively located at the four comers of the cylinder head 24, can be provided with one rib 29. Each of the remaining head bolt fastening portions 28 can be provided with two ribs 29 that extend toward the respective axes of the opposite cylinder barrels 23*a*. However, other numbers of ribs 29 can also be provided in other configurations.

The head bolt fastening portion 28 can be designed to receive a bolt for fastening the cylinder head 24 to the cylinder body 23. The rib 29 can provide reinforcement for the head bolt fastening portion 28. Additionally, the size and shape of the ribs 29 can be configured to adjust the flow of cooling water supplied to the water jacket 27 from the cooling ,water passage 23*b* of the cylinder body 23 through the introduction ports 27*a*.

Figure 7:
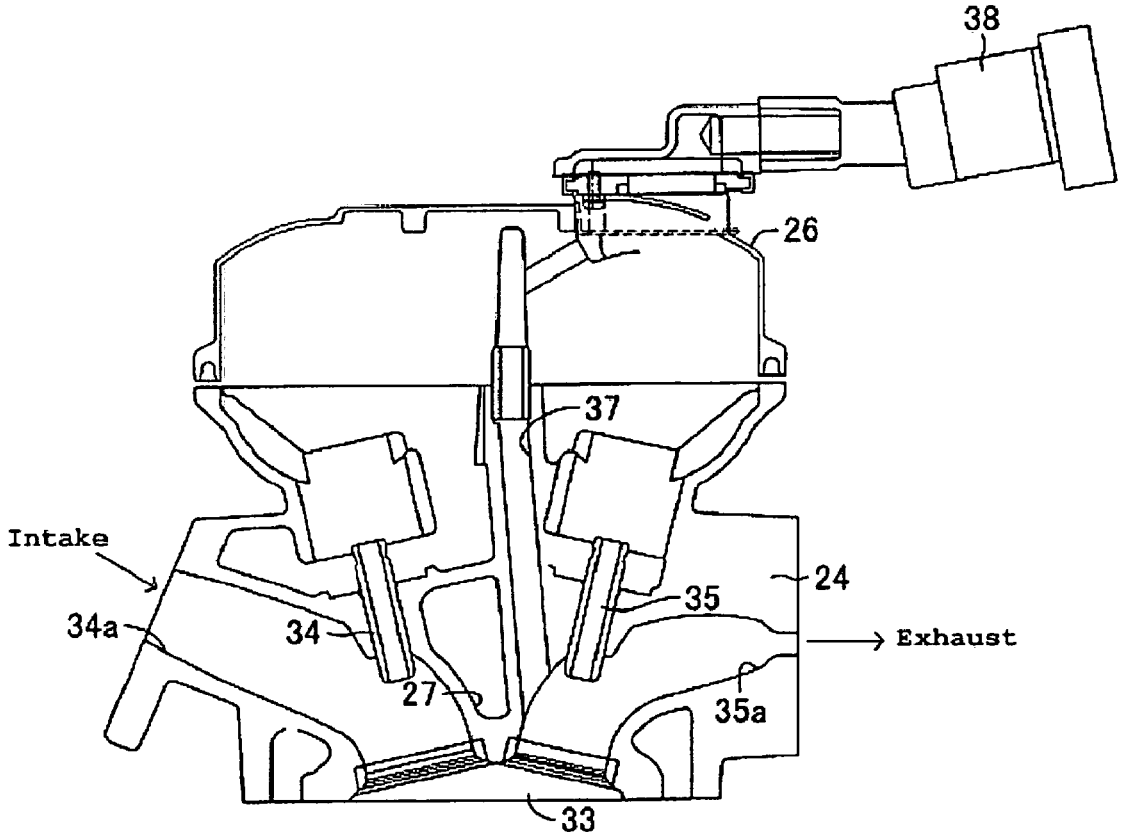
FIG. 7 is a sectional view of a head cover and an air-cut valve on the top of the section taken along the line 7-7 of FIG. 3.

Inside the cylinder body 23, a piston 32 can be connected to the crankshaft 21 via a connection rod 31 such that the piston can move up and down, as shown in FIG. 2. The up/down movements of the piston 32 are transmitted to the crankshaft 21 to rotate the crankshafts 21. As shown in FIG. 7, each cylinder 33 disposed in the cylinder head 24 can be provided with intake valves (not shown) located at intake valve mounting portions 34 and exhaust valves (not shown) located at exhaust valve mounting portions 35.

Intake ports 34*a* can be configured to communicate with the intake valves of each cylinder 33. The intake ports 34*a* can be connected to the intake system.

Exhaust ports 35*a* can be configured to communicate with the exhaust valves. Additionally , the exhaust ports , 35*a* can be connected to the exhaust system.

During operation, the intake valves open during the intake stroke of the respective pistons 32 to feed mixtures of air, supplied by the intake system via the intake ports 34*a* fuel, supplied from the fuel tank 15, to the combustion chambers defined by the cylinder head 24. The intake valves also close during the exhaust stroke.

The exhaust valves open during the exhaust stroke, to allow combustion gases to be discharged from the cylinder head 24 through the exhaust ports 35*a* to the exhaust system. Additionally, the exhaust valves 35*a* close ,during the intake stroke.

The engine 20 can also be provided with an ignition plug (not shown) ignition plug mounting hole 36. The ignition plug can be configured to ignite the mixture, and the mixture then explodes. The explosion drives the piston 32 to downwardly, thereby rotating the crankshaft 21.

A secondary air hole 37 can extend obliquely from the top of the cylinder head 24 toward the exhaust port 35*a*. The upper end of the secondary air hole 37 can be located approximately the center of the cylinder head 24 and the lower end can extend obliquely downwardly toward the portside through the topside of the exhaust port 35*a* . The secondary air hole 37 can thus reduce an angle between the intake and exhaust valves, resulting in a compact engine 20.

This secondary air hole can be angled relative to the exhaust port 35*a*, to result in improved intake efficiency of secondary air into the exhaust port 35*a*. On the topside of the head cover 26, an air-cut valve can be provided for delivering air to the secondary air hole 37. The distal end of the air-cut valve 38 can be disposed so as to communicate with the upper end of the secondary air hole 37. Delivering air from the air-cut valve through the secondary air hole 37 to the exhaust port 35*a* allows exhaust gases within the exhaust port 35*a* to be burnt more completely. The more completely burnt exhaust gases can then be delivered to the exhaust system.

Figure 8:
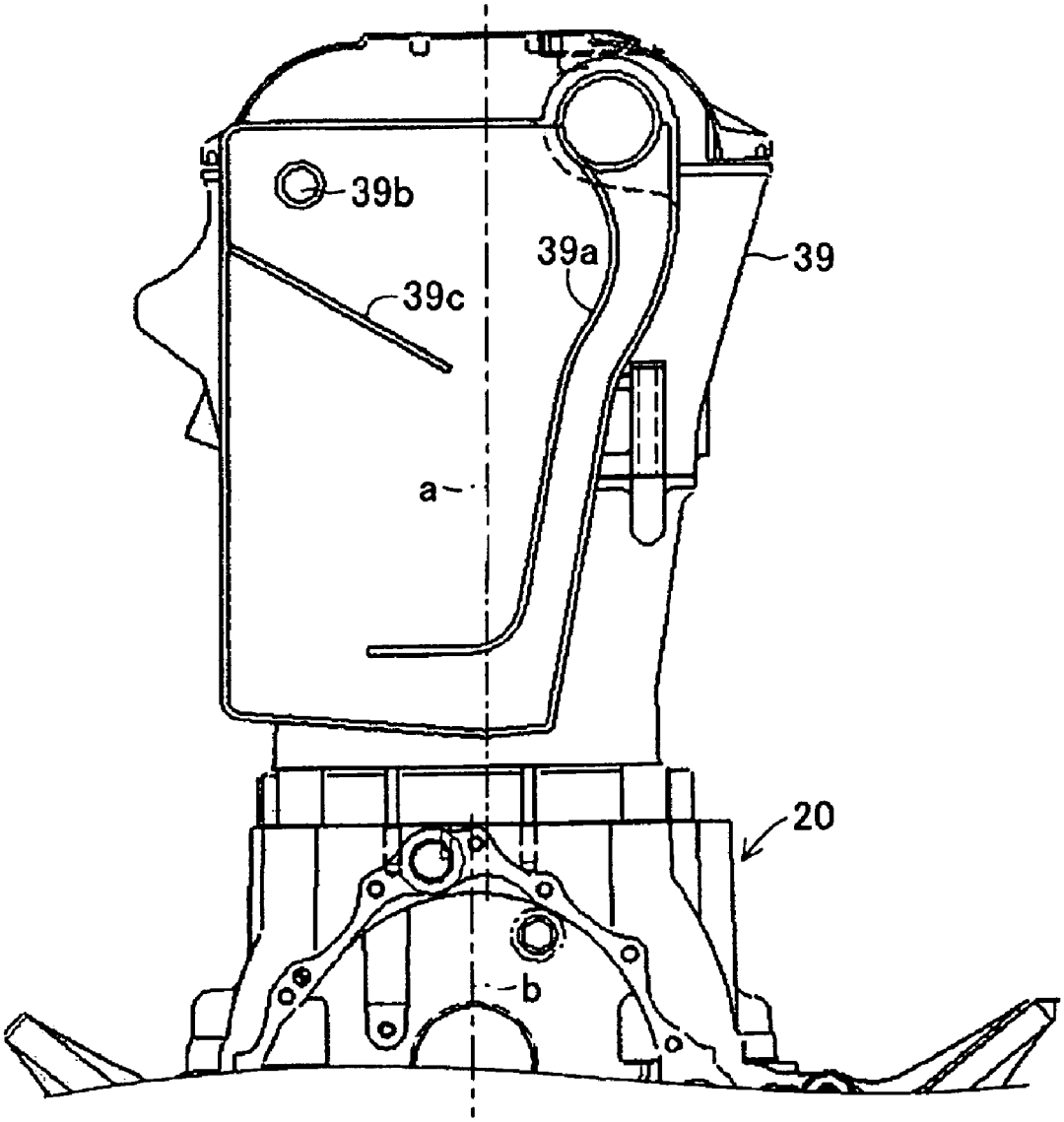
FIG. 8 is a sectional view of an interior of a ventilation case.

With reference to FIG. 8, a ventilation case 39 can be disposed rearwardly of the engine 20. The ventilation case 39 can be designed to introduce blow-by gases leaked from the engine 20 to separate oil from the blow-by gases.

An internal space of the ventilation case 39 can be provided with a guide passage 39*a* configured to guide the blow-by gases from the upper end to the lower end of the ventilation case 39. A gas discharge section 39*b* can be provided for discharging the gases separated from oil to the outside location. An inclined guide section 39*c* can also be provided for aiding in re-directing mist oil downwardly that may have been entrained in gases moving upwardly within the case 39.

The ventilation case 39 can be positioned at the upper end of the engine 20 such that an axis (a) of the ventilation case 39 lies approximately on the axis (b) of the engine 20. With this structure, the oil is prevented from flowing back in the reverse direction when the boat 10 capsizes.

A pump drive shaft 18 can be connected to the crankshaft 21 at a rear of the engine 20, via a coupling 21*a* . The pump drive shaft 18 can extend rearwardly toward the pump compartment 14.

The pump drive shaft 18 can be connected to an impeller provided inside the jet propulsion unit 17, and thus can transmit the rotational force of the crankshaft 21 to rotate the impeller. The propulsion unit 17 can be provided with a water intake 17*a* with an opening toward the bottom of the body 11, and a water ejection port 17*b* with an opening toward the stern. Water from the body of water in which the boat 10 is operating can be drawn into the water intake 17*a* and ejected from the water injection port 317*b* by the rotating impeller, thereby producing propulsion force for the body 11.

Additionally, a steering nozzle 19 can be attached to the rear end portion of the propulsion unit 17 and configured to change a traveling direction of the planing -type boat 10 rightwardly or leftwardly by allowing its rear portion side to be moved rightward or leftward in response to operation of the steering handlebars. A reverse gate or "reverse bucket" 19*a* can be mounted rearwardly of the steering nozzle 19. The reverse gate 19*a* can be configured to move up and down to change the traveling direction for the water planing boat 10 to the fore-and-aft direction.

The planing -type boat 10 can also have, in addition to the devices described above, an electrical control unit including a CPU, a ROM, a RAM, and a timer, electric component boxes accommodating various electrical components or devices, and various other devices, such as a start switch and sensors, that are useful for operating the water planing boat 10.

As described above, the water jacket 27 of the engine 20 for the planing -type boat 10 includes the ceiling 27*b* having its rearward portion higher than its forward portion. Additionally, the water drain 27*c* can be provided at the rear highest portion of the water jacket 27 to discharge cooling water. Thus, air that may enter the water jacket 27 together with cooling water can be discharged from the water drain 27*c* smoothly. This helps ensures that the air is discharged out of the water jacket 27, and thus helps prevent a reduction of the cooling effect of the water jacket 27 that may occur due to the air accumulated inside the water jacket 27.

The water drain 27*c* can be designed to discharge cooling water out of the water jacket 27 and can be located rearward of the engine 20, so that a distance between the water drain 27*c* and a discharge port at the stem is reduced. This results in a reduced length of piping for discharging cooling water, and therefore a more simple piping arrangement.

Under some operating conditions, the planing -type boat 10 can be propelled forward with its front portion (or bow) higher than its rear portion which is referred to as a "bow up" trim position or "trim angle". If a trim angle is smaller than an inclined angle of the ceiling 27*b*, the water planing boat 10 allows air to be reliably discharged without influence of the trim action. Under some operating, conditions, the planning-type boat 10 can be propelled forward with its front portion (or bow) higher than its rear portion which is referred to as a "bow up" trim position or "trim angle". If a trim angle is smaller than an inclined angle of the ceiling 27*b*, the water planing boat 10 allows air to be reliably discharged without influence of the trim action.

Additionally, as noted above, the rib 29 disposed within the water jacket 27 can provide a flow adjustment effect for cooling water moving within the water jacket 27 to improve the cooling effect, for example, by increasing the mixing of the cooling water flowing therein. However, the rib 29 can also provide other effects on the cooling water.

The rib 29 can also enhance the rigidity of a place proximate to the head bolt fastening portion 28, and therefore increases a force than can be used to fasten the bolt. Thereby, the cylinder head 24 and the cylinder body 23 are rigidly assembled together. In addition, a sealability of the mating face between the cylinder head 24 and the cylinder body 23 improves.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An engine for a planing-type boat, the engine including an engine cooling jacket and being configured to be mounted in the planing-type boat such that including an engine cooling jacket provided on an upper side of an engine body to cool the engine with water, the engine being a four stroke engine, the engine comprising:

a crankcase with a crankshaft housed within the crankcase;

a cylinder block including at least first and second cylinders, first and second pistons disposed in the first and second cylinders, respectively, the cylinder block including first and second apertures at upper ends of the first and second cylinders, respectively;

a one-piece cylinder head having a surface facing toward the first and second cylinders and covering the first and second openings, thereby forming first and second combustion chambers with the first and second cylinders, the crankcase, the cylinder block, and the cylinder head including respective outer surfaces forming respective parts of an outer surface of the engine body, the cylinder head including at least first and second exhaust ports extending from the first and second combustion chambers to first and second exhaust port openings on the outer surface of the cylinder head, respectively, the cylinder head further comprising at least first and second intake ports extending from the first and second combustion chambers to first and second intake port openings disposed on the outer surface of the cylinder head, the cylinder head further comprising at least first and second ignition plug mounting holes extending from the first and second combustion chambers, respectively;

the engine water jacket extending through the cylinder head into thermal communication with at least the first and second intake ports, the first and second ignition plug mounting holes, and the first and second combustion chambers, the engine water jacket also comprising a ceiling having a frontward portion and a rearward portion, a highest portion of the rearward portion of the ceiling being higher than a highest portion of the frontward portion, and a water drain provided adjacent to the highest portion of the water jacket to discharge the cooling water out of the water jacket.

2. The engine water jacket for a planing-type boat according to claim 1, wherein a head bolt fastening portion for receiving a bolt is provided on an outer side portion of the water jacket in the engine body, and a rib is provided in a portion of the water jacket that corresponds to the head bolt fastening portion.

3. The engine water jacket for a planing-type boat according to claim 1, wherein the ceiling is arranged such that a forward end of the ceiling is closer to a horizontal plane than a rearward end of the ceiling, said horizontal plane including an axis of a crankshaft of the engine.

4. The engine water jacket for a planing-type boat according to claim 1, wherein the ceiling of the engine water jacket is inclined upwardly towards a rear of the planing-type boat.

5. A watercraft comprising a hull, an engine supported by the hull, the engine being a four stroke engine, the engine comprising:

a crankcase with a crankshaft housed within the crankcase;

a cylinder block including at least first and second cylinders, first and second pistons disposed in the first and second cylinders, respectively, the cylinder block including first and second apertures at upper ends of the first and second cylinders, respectively;

a one-piece cylinder head having a surface facing toward the first and second cylinders and covering the first and second openings, thereby forming first and second combustion chambers with the first and second cylinders, the crankcase, the cylinder block, and the cylinder head including respective outer surfaces forming respective parts of an outer surface of the engine body, the cylinder head including at least first and second exhaust ports extending from the first and second combustion chambers to first and second exhaust port openings on the outer surface of the cylinder head, respectively, the cylinder head further comprising at least first and second intake ports extending from the first and second combustion chambers to first and second intake port openings disposed on the outer surface of the cylinder head, the cylinder head further comprising at least first and second ignition plug mounting holes extending from the first and second combustion chambers, respectively; and a cooling jacket extending through the cylinder head into thermal communication with at least the first and second intake ports, the first and second ignition plug mounting holes, and the first and second combustion chambers, the engine water jacket also comprising a ceiling, the ceiling of the cooling jacket being disposed at an upper portion of the engine in the cylinder head, the ceiling having a frontward portion and a rearward portion, a highest portion of the rearward portion of the ceiling being higher than a highest portion of the frontward portion.

6. The watercraft according to claim 5, wherein the ceiling of the cooling jacket is inclined upwardly towards a rear of the watercraft.

7. The watercraft according to claim 6, wherein the crankshaft of the engine is inclined downwardly toward a rear of the watercraft.

8. The watercraft according to claim 5, wherein the crankshaft of the engine is inclined downwardly toward a rear of the watercraft.

9. The watercraft according to claim 5, wherein the engine includes a cylinder head, the cylinder head defining at least a portion of the cooling jacket, the cylinder head having a through hole configured to receive a fastener for securing the cylinder head to a cylinder block and being disposed adjacent to a cylinder of the engine, and a rib extending from the through hole, across the cooling jacket, and radially inwardly toward a cylinder axis of the cylinder.

10. The watercraft according to claim 5 additionally comprising a cooling water discharge disposed at the rear end of the cooling jacket, adjacent the ceiling.

11. The watercraft according to claim 5, wherein the ceiling extends rearwardly towards a rear portion of the cooling jacket, the watercraft additionally comprising a cooling water discharge disposed in the vicinity of an uppermost portion of the ceiling.

12. The watercraft according to claim 5, wherein the ceiling is arranged so as to guide air to flow upwardly in the cooling jacket toward a rear portion of the cooling jacket.

13. The watercraft according to claim 5, wherein the ceiling is arranged such that the rear end of the ceiling is higher than the front end of the ceiling when the watercraft is in a bow up trim position.

14. A marine engine comprising a crankshaft and a cooling jacket, the marine engine comprising:

a crankcase with the crankshaft housed within the crankcase;

a main power take off disposed at a first end of the crankshaft configured to drive a propulsion unit of a boat;

a cylinder block including at least first and second cylinders, first and second pistons disposed in the first and second cylinders, respectively, the cylinder block including first and second apertures at upper ends of the first and second cylinders, respectively;

a one-piece cylinder head having a surface facing toward the first and second cylinders and covering the first and second openings, thereby forming first and second combustion chambers with the first and second cylinders, the crankcase, the cylinder block, and the cylinder head including respective outer surfaces forming respective parts of an outer surface of the engine body, the cylinder head including at least first and second exhaust ports extending from the first and second combustion chambers to first and second exhaust port openings on the outer surface of the cylinder head, respectively, the cylinder head further comprising at least first and second intake ports extending from the first and second combustion chambers to first and second intake port openings disposed on the outer surface of the cylinder head, the cylinder head further comprising at least first and second ignition plug mounting holes extending from the first and second combustion chambers, respectively;

the cooling jacket extending through the cylinder head into thermal communication with at least the first and second intake ports, the first and second ignition plug mounting holes, and the first and second combustion chambers, the cooling jacket also comprising a cooling water discharge disposed generally at a first longitudinal end of the engine, the cooling jacket further having a ceiling with frontward portion and a rearward portion, the rearward portion being disposed generally at the first longitudinal end of the engine, a highest portion of the rearward portion of the ceiling being higher than a highest portion of the frontward portion of the ceiling, and means for guiding air within the cooling jacket upwardly and longitudinally along the engine toward the cooling water discharge.

* * * * *

UNITED STATES PATENT AND TRADEMARK OFFICE

CERTIFICATE OF CORRECTION

PATENT NO. : 7,647,901 B2
APPLICATION NO. : 11/507703
DATED : January 19, 2010
INVENTOR(S) : Keiya Funahashi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 203 days.

Signed and Sealed this

Sixteenth Day of November, 2010

David J. Kappos

David J. Kappos
*Director of the United States Patent and Trademark Office*